US005998942A

United States Patent [19]

Bailly

[11] Patent Number: 5,998,942

[45] Date of Patent: Dec. 7, 1999

[54] DEVICE FOR STARTING AND SUPPLYING A FLUORESCENT TUBE

[75] Inventor: Alain Bailly, Simiane, France

[73] Assignee: SGS-Thomson Microelectronics S.A., Gentilly, France

[21] Appl. No.: 08/923,282

[22] Filed: Sep. 4, 1997

[30] Foreign Application Priority Data

Sep. 6, 1996 [FR] France ..... 96 11098

[51] Int. Cl.[6] ..... G05F 1/00

[52] U.S. Cl. ..... 315/307; 315/119; 315/244; 315/DIG. 5

[58] Field of Search ..... 315/224, 244, 315/307, 360, 362, DIG. 5, 119, 127, 306; 362/217

[56] References Cited

U.S. PATENT DOCUMENTS

| | | | |
|---|---|---|---|
| 4,477,748 | 10/1984 | Grubbs | 315/306 |
| 5,032,958 | 7/1991 | Harwood | 362/217 |
| 5,382,882 | 1/1995 | Nerone | 315/307 |
| 5,426,350 | 6/1995 | Lai | 315/244 |
| 5,444,336 | 8/1995 | Ozawa et al. | 315/307 |
| 5,574,335 | 11/1996 | Sun | 315/119 |
| 5,677,602 | 10/1997 | Paul et al. | 315/224 |

FOREIGN PATENT DOCUMENTS

| | | |
|---|---|---|
| 0 435 228 A2 | 7/1991 | European Pat. Off. . |
| 0 456 247 A1 | 11/1991 | European Pat. Off. . |
| 0 621 744 A2 | 10/1994 | European Pat. Off. . |
| 06141549 | 5/1994 | Japan . |

*Primary Examiner*—Haissa Philogene
*Attorney, Agent, or Firm*—David V. Carlson; Kimton N. Eng; Seed and Berry LLP

[57] ABSTRACT

The present invention relates to a device for starting and supplying a fluorescent tube, including a resonant system connected to the tube and to a rectified supply circuit with a switch in series. A first detector controls the switch to turn off when the current provided by the supply exceeds a determined threshold; and a second detector controls the switch to turn on for each transition through zero of the voltage on a node of the resonant system and for each transition through a minimum of this voltage.

24 Claims, 6 Drawing Sheets

DEVICE FOR STARTING AND SUPPLYING A FLUORESCENT TUBE

TECHNICAL FIELD

The present invention relates to circuits for starting and supplying a fluorescent tube.

BACKGROUND OF THE INVENTION

Generally, a fluorescent tube has to be supplied at high frequency, for example, at frequencies of around 10 to 100 kHz. Besides, it has to receive particularly strong a.c. or pulsed voltages in the initial period in order to make it start. These pulses have to reach voltages of around 1,000 to 3,000 volts. Generally, to generate high voltages at high frequencies, the fluorescent tube is associated with a resonant network formed by inductances and capacitors, this network being connected to a d.c. or rectified a.c. supply via switches controlled so as to periodically excite the resonant network.

The implementation of a circuit for starting and supplying a fluorescent tube raises problems for the implementation of each of the system components.

As concerns the resonant circuit, one of the constraints is the high cost of the components, and especially the cost of capacitors which will have to withstand very high voltages and inductors which will have strong current running through them.

As concerns the switching circuit, it must, for the sake of economy, include the smallest possible number of switches and, preferably, all switches will have to be implementable on a monolithic silicon substrate. In practice, half-bridge systems are often used, because they impose smaller voltage withstanding constraints but they have the disadvantage of requiring at least two sets of monolithic switches.

As concerns the switching circuit control system, it has to be as simple as possible and have a low power consumption.

It should thus be clear that many compromises have to be made to provide an optimal start and supply system for a fluorescent tube, by reducing the number of components and thus the system cost.

SUMMARY OF THE INVENTION

An object of the present invention is to provide an optimized circuit for starting and supplying a fluorescent tube.

To achieve this general object, the present invention provides a device for starting and supplying a fluorescent tube, including a resonant system connected to the tube, this system having a first resonance frequency when the tube is started and at least second and third resonance frequencies when the tube is not started, the third resonance frequency being higher than the first and second resonance frequencies; a rectified supply circuit coupled to the resonant system; a switch in series between the supply and the resonant system; a first detector for controlling the switch to turn off when the current provided by the supply exceeds a determined threshold; and a second detector for controlling the switch to turn on for each transition through zero of the voltage on a node of the resonant system and for each transition through a minimum of this voltage.

According to an embodiment of the present invention, the resonant system includes a first capacitor and a first inductance connected in series across the tube, and a second capacitor and a second inductance connected in parallel across the tube, the second capacitor having a lower capacity than the first capacitor.

According to an embodiment of the present invention, the second detector includes a shunting circuit, the output of which is connected to a zero detector indicating transitions through zero in a determined direction.

According to an embodiment of the present invention, the second detector includes a transistor, the emitter of which is coupled to a node of the resonant system via a capacitor and the emitter of which is coupled to the base via a resistor, the base being coupled to the ground via a diode for letting a control current run through from the ground to the node via the resistor to bias the transistor upon conduction, and the time constant is much lower than the period of the resonance signal having the highest frequency which is desired to be detected.

According to an embodiment of the present invention, the switch includes a MOS power transistor, the gate of which is controlled to open and close, in series with a bipolar transistor, the base of which is constantly biased.

According to an embodiment of the present invention, the circuit includes a supply node coupled to the ground via a storage capacitor, this supply node being coupled on the one hand to the high supply via a high value resistor, on the other hand to the base of the bipolar transistor to receive therefrom a discharge current upon each opening of this transistor, and to the capacitor of the second detector to receive the excess charge therefrom.

The present invention also provides a method for starting and supplying a fluorescent tube including the steps of providing a resonant system connected across the tube, this system having a first resonance frequency when the tube is started and at least second and third resonance frequencies when the tube is not started, the third resonance frequency being higher than the first and second resonance frequencies; connecting this resonant system to a rectified supply circuit via a controlled switch; detecting the current in the switch and opening the switch each time this current exceeds a determined threshold; and detecting the voltage on a node of the resonant system and automatically adapting the closing of the switch to the highest of the resonance frequencies of the resonant circuit.

According to an embodiment of the present invention, the step of detecting the highest frequency of the resonant circuit consists of detecting the minima of the voltage present on a node of the resonant circuit and the transitions through zero of this voltage.

These objects, characteristics and advantages as well as others, of the present invention, will be discussed in detail in the following non-limiting description of specific embodiments of the present invention, in relation with the accompanying drawings.

DETAILED DESCRIPTION OF THE INVENTION

According to a characteristic of the present invention, the resonant circuit associated with the fluorescent tube according to the present invention has a first resonance frequency when the tube is on, and has several resonance frequencies, at least one of which is higher than the first resonance frequency, when the tube is not started yet (and when it is substantially equivalent to an open circuit). It should be noted in the specific example hereafter and it should be generally noted that the fact of operating at a higher frequency for given high voltages enables the capacitors, meant to withstand the high voltages to have lower values and also results in lower values for the currents in the network inductances. This thus enables to use lower cost capacitors and inductances.

Figure 1A:
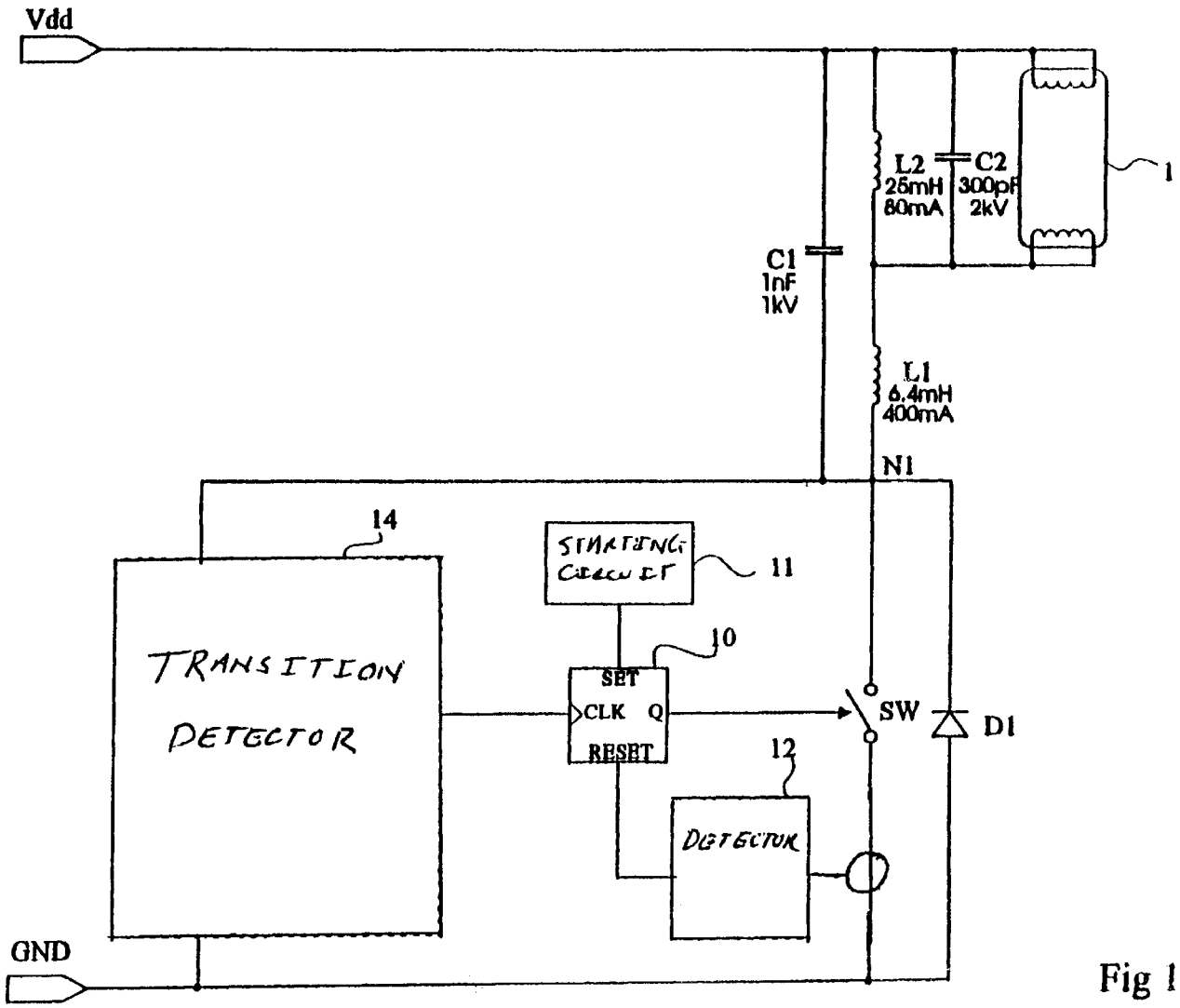
FIGS. 1A and 1B are block diagrams in differing detail of a circuit for starting and supplying a fluorescent tube according to the present invention.

More specifically, FIG. 1A shows a fluorescent tube 1 in which it has been assumed that there is no electrode preheating. This fluorescent tube is associated with a resonant network including capacitors C1 and C2 and inductances L1 and L2. Inductance L1 and capacitor C1 are connected in series across the tube. Inductance L2 and capacitor C2 are connected in parallel across the tube. A terminal of a d.c. supply source, for example a rectified a.c. supply Vdd, is connected to the terminal of the tube connected to a terminal of capacitors C1 and C2 and of inductance L2. The connecting point of capacitor C1 and inductance L1 forms a node N1 of the circuit.

A specific example, indicated as an example only, will be considered hereafter, in which the applied voltage is the rectified main supply voltage (220 V) and where the components of the resonant network have the following values:

C1=1 nF,

L1=6.4 mH,

L2=25 mH, and

C2=300 pF.

Those skilled in the art will note that, once a tube is started, it has a low impedance, for example, a resistance of around 500 Ω. Since the tube of FIG. 1A is arranged in parallel with capacitor C2 and impedance L2, the latter components are damped and no longer have influence over the resonant system once the tube is fully started. The resonant network is then substantially reduced to capacitor C1 and inductance L1 which then define the oscillation frequency (of around 90 kHz in the case of the above particular example).

When the tube is not started, it can be assumed that the circuit includes two main resonant circuits. A first resonant circuit is formed by inductances L1 and L2 in series with capacitor C1. This first resonant circuit will have a resonance frequency of around 28 kHz in the case of the above particular example. A second resonant circuit includes inductance L1 in series with capacitors C1 and C2. The resonance frequency of this second resonant circuit will be around 126 kHz in the case of the above particular example. This shows that the network will have at least two resonance frequencies when the tube is not started and gives approximate orders of magnitude of the resonance frequencies to indicate that there will exist a high resonance frequency clearly higher than the resonance frequency in the started state and a low resonance frequency. A wave with a complex form including at least the superposition of a high frequency signal and of a low frequency signal is thus obtained when the circuit oscillates.

Node N1 is connected to the second supply terminal GND (currently the ground) via a switch SW and is directly connected to terminal GND by a reverse-biased diode D1.

Switch SW is controlled by the Q output of a flip-flop 10 set to 1 by a starting circuit 11.

The reset input of flip-flop 10 is connected to a circuit 12 for detecting the current through switch SW, this detection circuit providing an output signal when the current exceeds a determined threshold, for example, a value of 200 milliamperes.

The clock input of flip-flop 10 is controlled by a detector circuit 14 which provides an active signal on the CLOCK input, that is, a signal switching from a low state to a high state when the voltage on node N1 remains at zero after having been positive or when this voltage transits through a minimum. This enables, as it will be seen hereafter, to control the switch on the highest frequency among the above-mentioned resonance frequencies.

Figure 2:
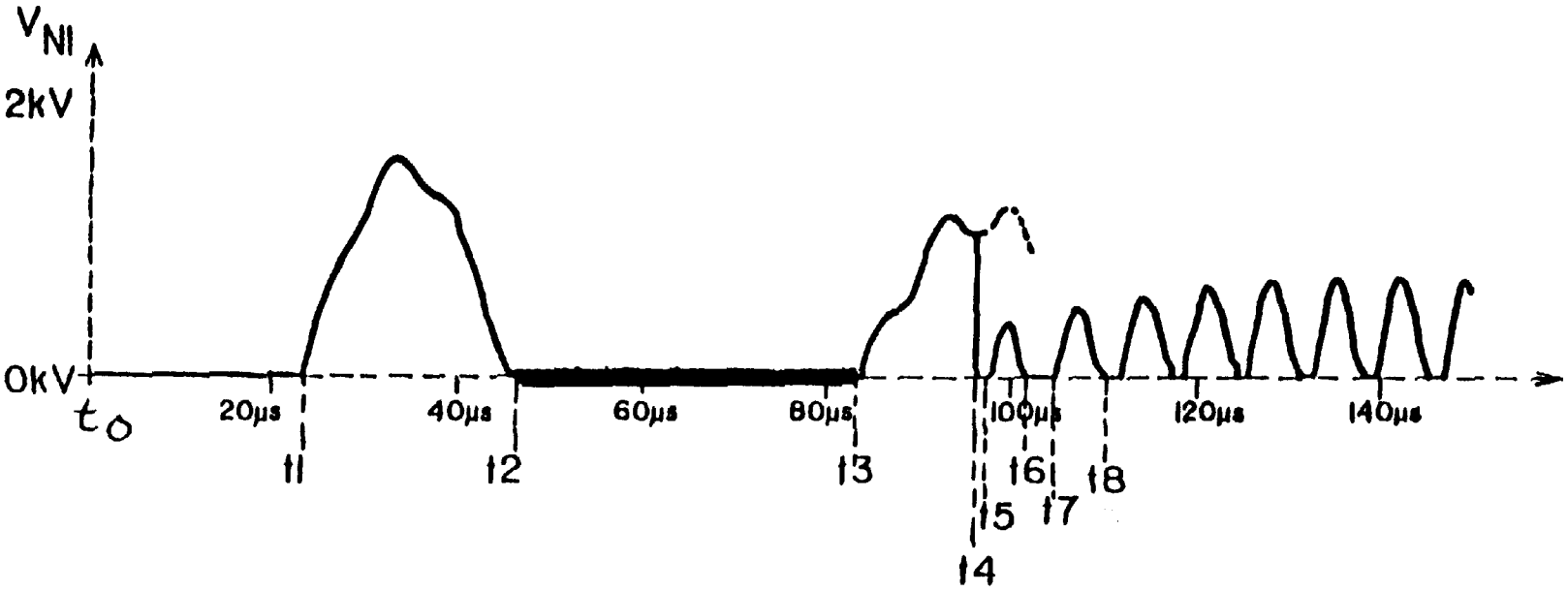
FIG. 2 shows the shape of signals occurring in a resonant circuit.

FIG. 2 is a graph of one example of the voltage on node N1. It is assumed that prior to $t_1$ switch SW is closed. The switch turns off at time $t_1$ as soon as the current flowing therethrough exceeds a threshold and the voltage at node N1 increases and has a relatively complex waveform illustrated between times t1 and t2, formed in particular by the superposition of the above-mentioned high and low resonance frequencies. At time t2, this voltage transits through zero and detector 14 provides a signal on input CLK of flip-flop 10 to close the switch. At time t3, when detector 12 has detected a current higher than 200 milliamperes, the switch opens. A complex waveform then appears again and a time will necessarily come (during this period, previous period t1–t2, or a subsequent period) when the superposition of the high and low frequencies will cause, at a time t4, this waveform to transit through a minimum. This minimum corresponds to a low value of the high frequency component. At this time, detector 14 provides a rising edge on the CLOCK input of flip-flop 10. The Q output of flip-flop 10 then applies a turn-on signal on the control terminal of switch SW. From this time on, there is a synchronization on the high frequency. And the switch turns off and on substantially at this frequency, the turning-off occurring each time the current through the switch exceeds a value of 200 milliamperes and the turning-on occurring for each new transition through a minimum or transition through zero of the high frequency voltage.

Figure 1B:
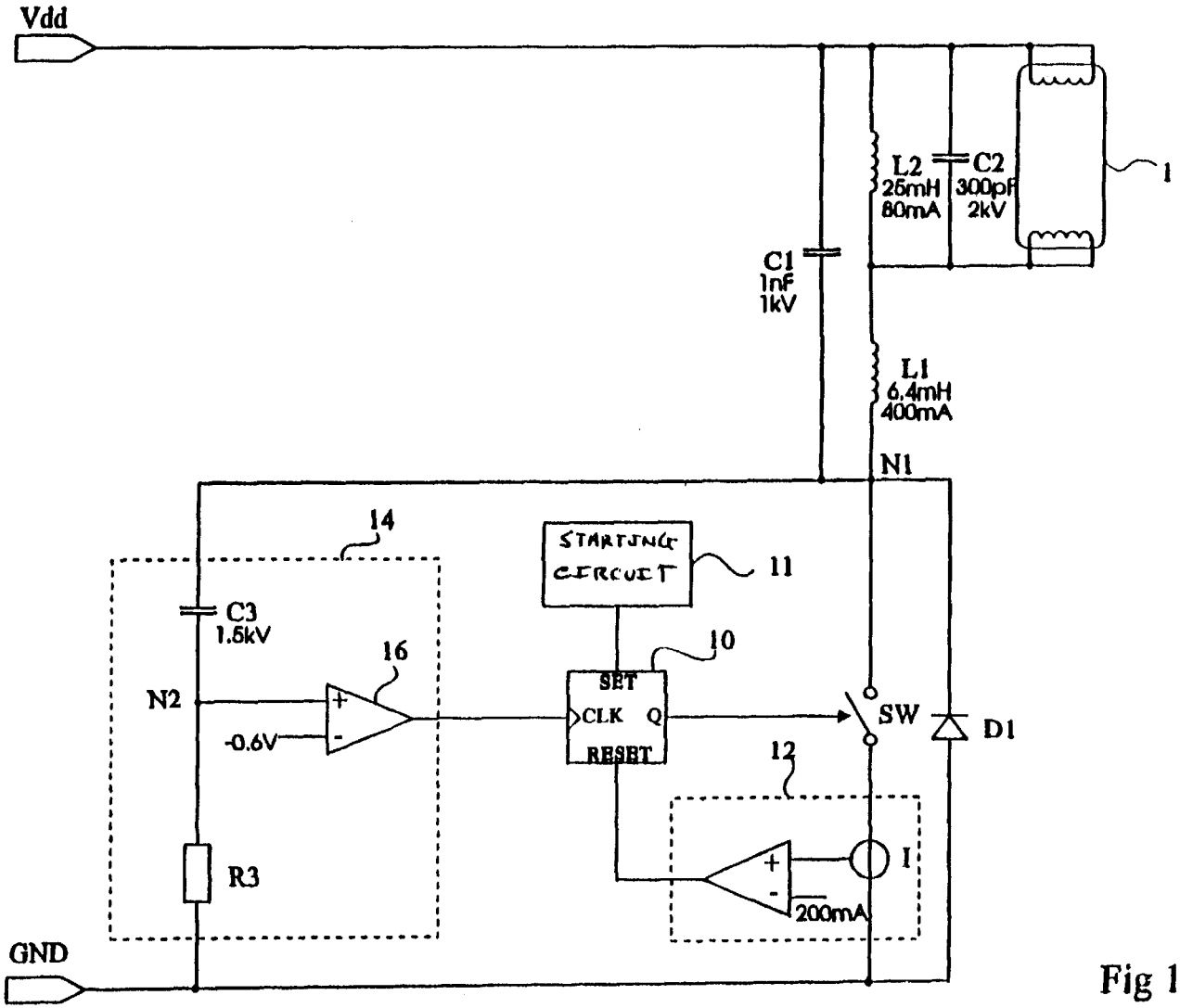

FIG. 1B shows a simplified embodiment of detector 14. This detector includes, between node N1 and the ground (GND), a capacitor C3 and a resistor R3, the connecting point N2 of which is connected to an input of a comparator 16. The other input of the comparator is connected to a negative reference voltage. This negative reference enables to cause a positive edge on input CLK of flip-flop 10 when the voltage on node N1 remains at 0 (or at −0.6 volt because of the presence of diode D1) after having been positive. Time constant R3C3 is chosen to be much lower than the period of the signal corresponding to the highest resonance frequency. The assembly operates as a shunter and the voltage at node N2 transits through zero for each slope change of the voltage on node N1. Comparator 16 provides a transition from a high state to a low state when the voltage on node N1 transits through a maximum and from a low state to a high state when it transits through a minimum. Flip-flop 10 only provides a signal on its Q output for transitions from a low state to a high state on its CLOCK input. The desired switch control signal which automatically synchronizes on the highest frequency signal among the resonant circuit signal components is thus actually obtained.

Besides, numerical examples of values of capacitors C1 and C2 have been previously indicated. It should be reminded that capacitor C2 has a much lower capacitance than capacitor C1. If its capacitance is, for example, three times lower, the voltage across it will be approximately three times stronger, that is, if the voltage across capacitor C1 is around 300 volts, peak-to-peak voltages of around one thousand volts will be obtained across capacitor C2, which is enough to start the fluorescent tube.

After a number of switchings of switch SW at the high frequency, the fluorescent tube will start and, as it has been indicated previously, only capacitor C1 and inductance L1 will then be active in the resonant circuit. Then, detector 14 will automatically adjust on the new frequency and will provide switching pulses for switch SW for each transition through zero of the a.c. voltage corresponding to the resonance frequency of network L1-C1.

Figure 3:
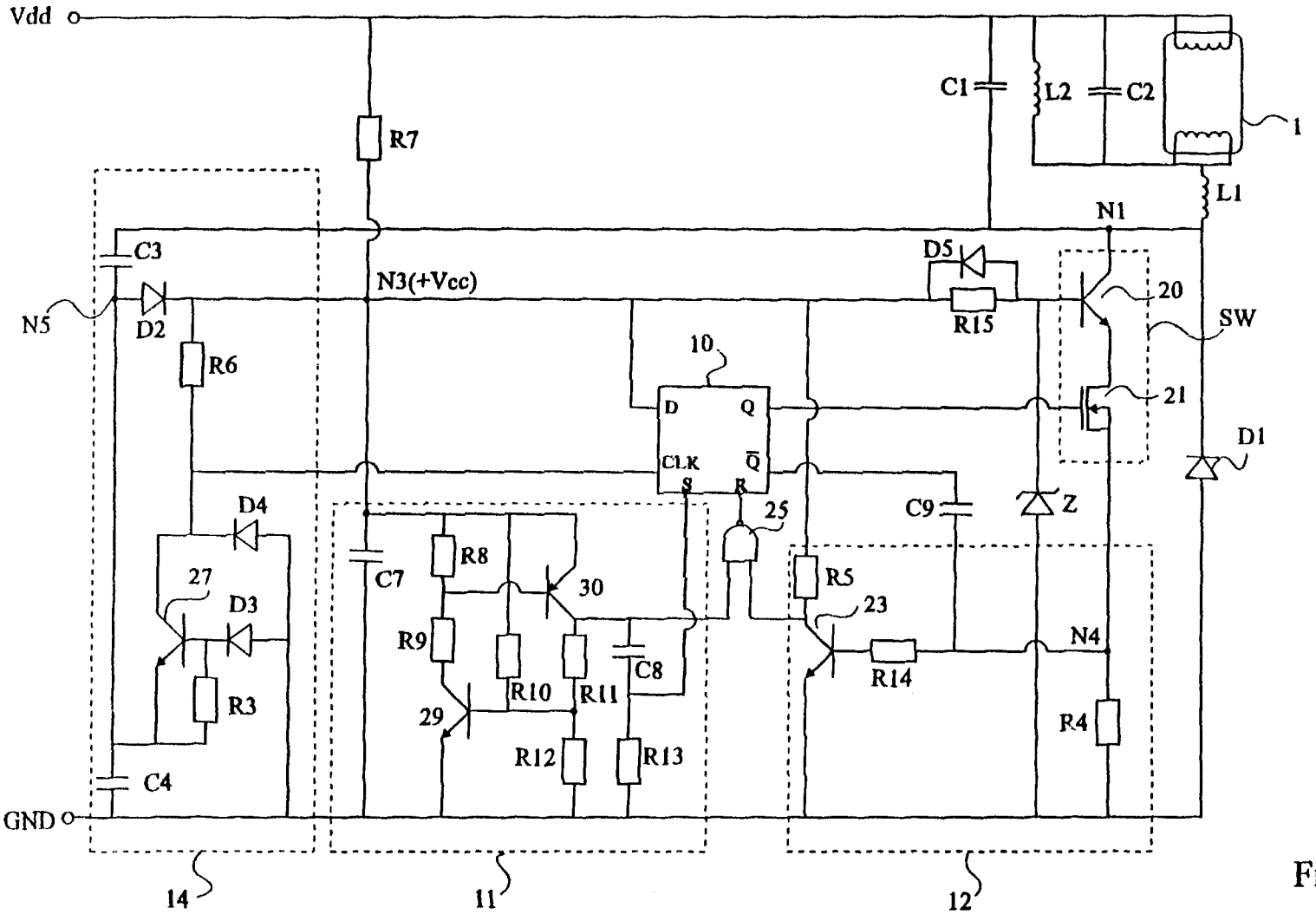
FIG. 3 shows a more detailed embodiment of the circuit of FIG. 1A.

FIG. 3 shows a more detailed example of implementation of the circuit of FIGS. 1A and 1B. In this drawing, the same components as those in FIGS. 1A and 1B are referred to by the same reference numbers.

The resonant system associated with tube 1 is identical to that in FIGS. 1A and 1B.

Switch SW is implemented by a cascode assembly of a bipolar transistor 20 and of a MOS transistor 21. Such components can be implemented monolithically in a single chip, for example, in bipolar-MOS integration technologies developed by SGS-THOMSON. The collector of transistor 20 is connected to node N1, its emitter to the drain of transistor 21, and its base to a node N3 on which a low supply voltage (+Vcc) is available. The drain of transistor 21 is connected to the ground via a measuring resistor R4. The gate of transistor 21 is connected to the Q output of flip-flop 10. Transistor 20 is constantly biased in the on state and a current actually flows through it only when MOS transistor 21 becomes conductive. The essential function of bipolar transistor 20 is to limit the voltage across MOS transistor 21 which only sees the emitter voltage of this transistor 20 (substantially equal to voltage Vcc). Indeed, it is technologically easier to implement a bipolar transistor withstanding a high voltage than a MOS transistor withstanding a high voltage.

Current detector 12 includes a resistor R4, the voltage of which (node N4) is applied to the base of an NPN transistor 23 having its emitter connected to the ground and its collector connected to supply node N3 via a resistor R5. The collector voltage of transistor 23 is applied to reset input R of flip-flop 10. Thus, as soon as the voltage across resistor R4 exceeds the base-emitter voltage of transistor 23 (substantially 0.6 volts), this transistor turns on and a low level appears on its collector. The low level is applied via an inverter (a first input of a NAND gate 25) to input R. If it is desired that MOS transistor 21 opens as soon as a current of around 200 milliamperes flows through it, a value of 3 Ω will be chosen for resistance R4.

Circuit 14 for detecting the transition through a minimum or through zero of the voltage on node N1 includes capacitor C3, a first terminal of which is connected to this node N1 and the second terminal of which is grounded via a capacitor C4. Reference N5 designates the connecting point of capacitors C3 and C4. Node N5 is connected to node N3 via a diode D2. Besides, circuit 14 includes a resistor R3 connected between the base and the emitter of a transistor 27, the emitter of which is connected to node N5 and the collector of which is connected to node N3 via a resistor R6. The ground is connected to the base of transistor 27 via a diode D3 and to the collector of this transistor via a diode D4. If node N5 is more positive than −1.2 V, transistor 27 is blocked. If node N5 becomes more negative than −1.2 V, that is, a current flows through capacitor C3 from node N5 to node N1, this current flows from the ground through diode D3 and resistor R3 to node N5 and the voltage which develops across resistor R3 turns transistor 27 on. Its collector then switches from the voltage level of node N3 (high level) to the voltage level of node N5 (low level). This transition causes the occurrence of a signal on input CLK. The same phenomenon occurs when the voltage of node N1 remains at zero after having been positive. In this case, resistor R3 blocks transistor 27 after canceling the current through capacitor C3.

Starting circuit 11 first includes a resistor R7 and a capacitor C7. Resistor R7, connected between voltage Vdd and node N3, charges capacitor C7, connected between node N3 and the ground, as soon as a voltage is applied on terminal Vdd and positively biases node N3. A Zener diode Z, sets the maximum voltage level. As soon as capacitor C7 is sufficiently charged, a circuit including resistors R8, R9, R10, R11, R12, R13, NPN and PNP transistors 29 and 30, and a capacitor C8, connected as illustrated, provides a signal on the set input, S, of the flip-flop and on the R input thereof via above-mentioned gate 25. The voltage on node N3 is applied to the D input of the flip-flop. As long as the voltage on node N3 is too low, transistors 29 and 30 are blocked and flip-flop 10 is maintained in a blocked state by the signal applied to gate 25. When the voltage on node N3 crosses the starting threshold of transistors 29 and 30, capacitor C8 applies a pulse on the S input of the flip-flop.

Further, the signal on the Q input of flip-flop 10 is applied via a capacitor C9 and a resistor R14 to the base of transistor 23 to reset it with a certain delay. The Q output is used to inhibit the operation of transistor 23 upon each turning on of switch SW. Indeed, switch SW can be turned on when there is a high voltage at its terminals, which induces a lot of current through resistor R4. Capacitor C9 enables application of a negative pulse on the base of transistor 23, which avoids blocking flip-flop 10 again just after its setting to 1.

An aspect of the present invention also resides in the elaboration mode of the low supply voltage on node N3. An initial charge step via resistor R7 has been indicated. The present invention provides two other means for supplying this d.c. voltage. The first means consists in the fact that, each time transistor 20 opens due to the blocking of MOS transistor 21, the charges stored in the transistor will eliminate towards node N3 via a resistor R15. The second means uses any excess energy on capacitor C3 which is discharged via diode D2 into this node N3. Thus, for this charge, essentially voltages and charges which would otherwise be lost are used. This enables maintenance of a sufficient voltage on node N3 during all operating phases by keeping a resistor R7 with a very high value (for example, 1 MΩ) to limit the unnecessary consumption of the circuit.

Figure 4:
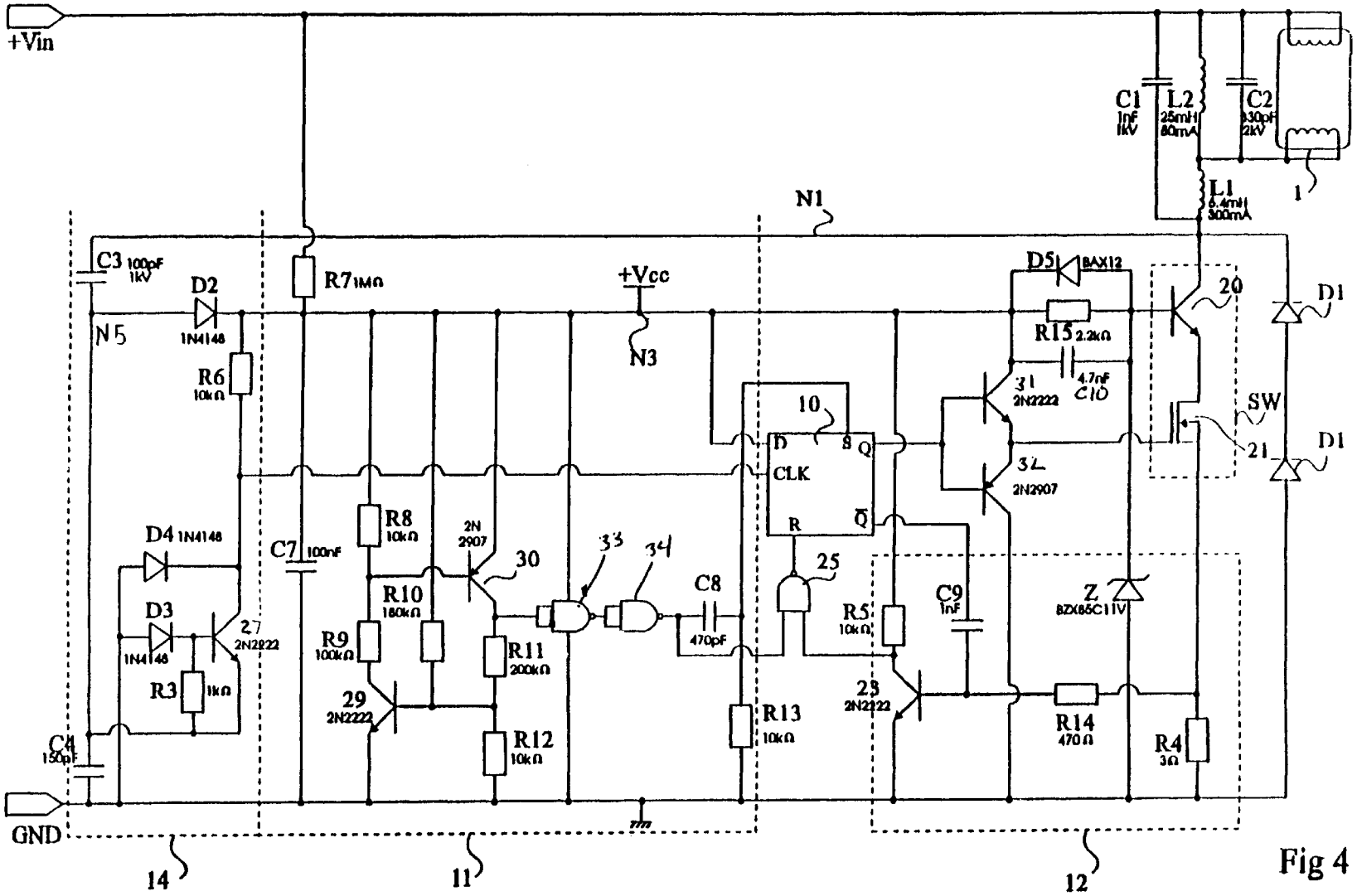
FIG. 4 shows a detailed example of embodiment of the circuit of FIG. 3.

FIG. 4 shows a detailed embodiment of the present invention. In this drawing, some additional components with respect to those in FIG. 3, for ensuring proper circuit operation, have been shown. In particular, the Q output of flip-flop 10 is applied to the gate of switching MOS transistor 21 via an amplifier circuit 31, 32 and the output voltage of the supply circuit is applied via two inverters 33, 34. The usefulness of the other added components will be clearly apparent to those skilled in the art. Moreover, the value and/or the type of each component used in a specific embodiment have been indicated in the drawing. These values, indicated as an example, will be considered to be part of the present invention.

Thus, the present invention provides a simple control system for a switch enabling it to automatically adapt on the highest frequency of a resonant system likely to oscillate at several frequencies.

The present invention is likely to have various alterations, modifications, and improvements which will readily occur to those skilled in the art. Especially, it should be noted that the numerical values indicated have been given as an example only. Further, a specific type of resonant circuit has been described. Several other resonant circuit structures may be used, the important point being that the circuit exhibits in the starting state a high resonance frequency which is automatically inhibited once the tube is started. Besides, an electrode heating system can be provided, and the resonant circuit can be modified accordingly.

Figure 5A:
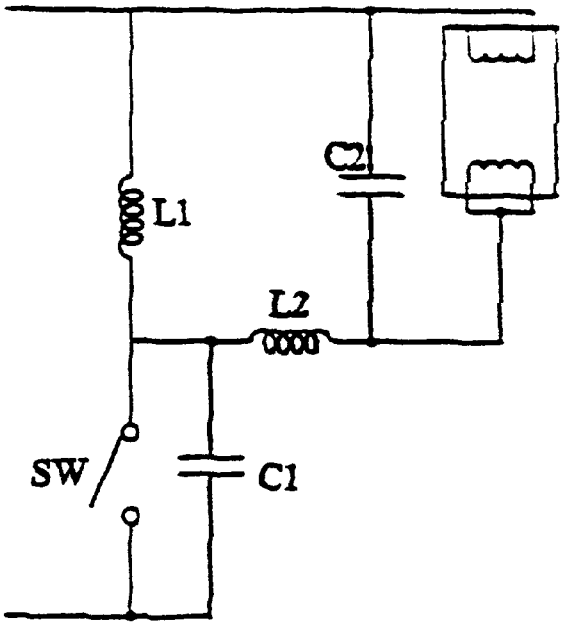
FIGS. 5A to 5C show alternative implementations of the resonant circuit.
Figure 5B:
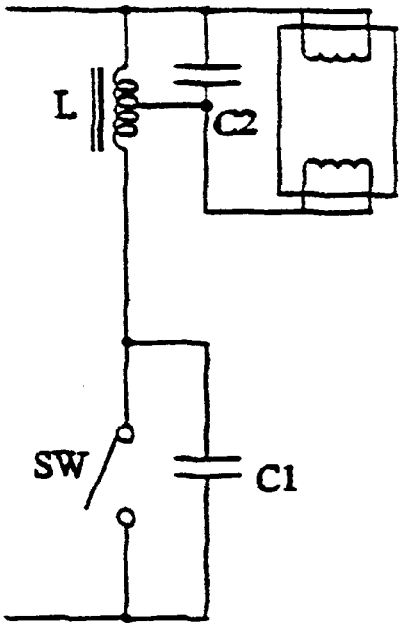
Figure 5C:
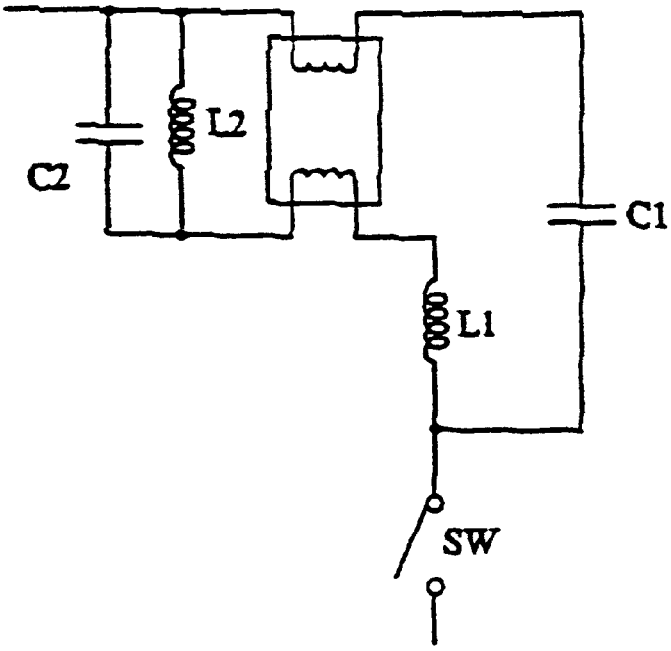

Examples of alternative resonant circuits are illustrated in FIGS. 5A, 5B, and 5C, the alternative of FIG. 5C providing electrode heating.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A device for starting and supplying a fluorescent tube, including:

a resonant system connected to the tube, this system having a first resonance frequency when the tube is started and at least second and third resonance frequencies when the tube is not started, the third resonance frequency being higher than the first and second resonance frequencies;

a rectified supply circuit connected to the resonant system;

a switch in series between the supply and the resonant system;

a first detector for controlling the switch to turn off when the current provided by the supply exceeds a determined threshold; and further including a second detector for controlling the switch to turn on for each transition through zero of the voltage on a node of the resonant system and for each transition through a minimum of this voltage.

2. The starting device according to claim 1, wherein the resonant system includes a first capacitor and a first inductance connected in series across the tube, and a second capacitor and a second inductance connected in parallel across the tube, the second capacitor having a lower capacity than that of the first capacitor.

3. The device according to claim 1, wherein the second detector includes a shunting circuit, the output of which is connected to a zero detector indicating transitions through zero in a determined direction.

4. The device according to claim 3, wherein the second detector includes a transistor, the emitter of which is connected to a node of the resonant system via a capacitor and the emitter of which is connected to the base via a resistor, the base being connected to the ground via a diode for letting a control current run through from a ground to the node via the resistor to bias the transistor upon conduction, and wherein a time constant is much lower than the period of the resonance signal having the highest frequency which is desired to be detected.

5. The device according to claim 1, wherein the switch includes a MOS power transistor, the gate of which is controlled to open and close, in series with a bipolar transistor, the base of which is constantly biased.

6. The device according to claims 1, 4, or 5, wherein the circuit includes a supply node connected to a ground via a storage capacitor, this supply node being coupled on the one hand to the rectified supply circuit via a high value resistor, on the other hand to the base of a bipolar transistor to receive therefrom a discharge current upon each opening of this transistor, and to the capacitor of the second detector to receive the excess charge therefrom.

7. A method for starting and supplying a fluorescent tube, including the following steps:

providing a resonant system connected across the tube, this system having a first resonance frequency when the tube is started and at least second and third resonance frequencies when the tube is not started, the third resonance frequency being higher than the first and second resonance frequencies;

connecting this resonant system to a rectified supply circuit via a controlled switch;

detecting a current in the switch and opening the switch each time this current exceeds a determined threshold; and detecting the voltage on a node of the resonant system and automatically adapting the closing of the switch to the highest of the resonance frequencies of the resonant system.

8. The method according to claim 7, wherein the step of detecting the highest frequency of the resonant system consists of detecting the minimum of the voltage present on a node of the resonant system and the transitions through zero of this voltage.

9. A device for starting and supplying power to a fluorescent tube, comprising:

a fluorescent tube;

a resonant system coupled to the fluorescent tube;

a switch coupled to the fluorescent tube and the resonant system;

a first detector coupled to the switch that provides a signal to open the switch;

a second detector coupled to the switch that provides a signal that closes the switch; and a rectified power supply coupled to the device.

10. The device for starting and supplying a fluorescent tube of claim 9, wherein the resonant system comprises an electrical network exhibiting at least three resonance frequencies, a first resonance frequency predominates when the fluorescent tube is started, and second and third resonance frequencies are dominant after the tube has been started, the third resonance frequency being the highest frequency present.

11. The resonant system of claim 9, further comprising:

a series resonant circuit, consisting of a first inductor and a first capacitor, connected in parallel with the fluorescent tube;

a parallel resonant circuit, consisting of a second inductor and a second capacitor, connected in parallel with the fluorescent tube and the series resonant circuit.

12. The resonant system of claim 11, wherein the second capacitor is of less capacitance than the first capacitance.

13. The first detector of claim 9, further comprising:

means to open the switch when the rectified supply current exceeds a predetermined threshold.

14. The second detector of claim 9, further comprising:

means to close the switch when the voltage present at a node of the resonant system transitions through zero and for each transition through a voltage minimum.

15. The second detector of claim 14, further comprising:

a shunting circuit; and a zero detector, coupled to the shunting circuit such that voltage transitions through zero may be detected.

16. The second detector of claim 14, further comprising:

a transistor having an emitter capacitively coupled to a node of the resonant system;

a resistor connected from a base to the emitter of the transistor; and a diode connected from the base of the transistor to ground.

17. The resistor and capacitor of claim 16, wherein the time constant of the resistor and capacitor is much lower than the period of the highest resonant frequency of the resonant system.

18. The switch of claim 9, further comprising:

a MOS power transistor connected in series with a bipolar transistor.

19. The MOS power transistor of claim 18, wherein the gate is controlled such that the transistor functions as a switch.

20. The bipolar transistor of claim 18 wherein the base is constantly biased.

21. The device for starting and supplying a fluorescent tube of claim 9, wherein the starting circuit substantially comprises:

a high valued resistor connected from the rectified power supply to a capacitor connected to ground;

a connection from the base of a bipolar transistor contained in the switch coupled to the junction of the resistor and capacitor; and a connection from the capacitor and resistor connection node of the shunting circuit of the second detector to the base of the bipolar transistor contained in the switch.

22. A method for starting and supplying a fluorescent tube, the method comprising the steps of:

constructing a resonant system;

connecting the resonant system across the fluorescent tube;

connecting the resonant system to a rectified supply circuit by means of a switch;

detecting a current through the switch;

opening the switch when the detected current exceeds a predetermined threshold;

detecting the voltage on a node of the resonant system; and automatically adapting the closing of the switch to the highest frequency of the resonant system.

23. The method of claim 22 wherein the forming of a resonant system comprises:

setting a first resonance frequency when the tube is started;

setting a second and third resonance frequency after the tube is started; and setting the third resonance frequency higher than the first and second resonance frequencies.

24. The method of claim 22 wherein adapting the closing of the switch to the highest frequency of the resonant system comprises:

detecting a voltage minimum; and detecting transitions through zero.

* * * * *